US005222869A

United States Patent [19]

Wunner et al.

[11] Patent Number: 5,222,869

[45] Date of Patent: Jun. 29, 1993

[54] LIQUID RING VACUUM PUMP-COMPRESSOR WITH ROTOR CONE CLEARANCE CONCENTRATED IN THE SEAL SEGMENT

[75] Inventors: Charles H. Wunner; T. Michael Wallace, both of Charlotte, N.C.

[73] Assignee: Vooner Vacuum Pumps, Inc., Charlotte, N.C.

[21] Appl. No.: 904,975

[22] Filed: Jun. 26, 1992

Related U.S. Application Data

[63] Continuation-in-part of Ser. No. 882,820, May 14, 1992.

[51] Int. Cl.[5] ..... F04C 19/00

[52] U.S. Cl. ..... 417/68; 29/888.02; 29/888.021; 29/527.4

[58] Field of Search ..... 417/68, 69; 29/888.02, 29/888.021, 527.4

[56] References Cited

U.S. PATENT DOCUMENTS

| | | | |
|---|---|---|---|
| Re. 29,747 | 8/1978 | Roe et al. . | |
| 3,209,987 | 10/1965 | Jennings . | |
| 3,712,764 | 1/1973 | Shearwood | 417/68 |
| 3,743,443 | 7/1973 | Jennings . | |
| 4,747,752 | 5/1988 | Samarakis . | |

*Primary Examiner*—Edward K. Look
*Assistant Examiner*—Christopher Verdier
*Attorney, Agent, or Firm*—Ralph H. Dougherty

[57] ABSTRACT

An improved liquid ring vacuum pump apparatus for reducing wear between the cone and rotor vanes, in which a novel cone structure has a greater thickness and greater external radius in the seal segment than in the remaining segments. An alternative embodiment includes a replaceable wear plate in the seal segment. The cone structure includes grooves and notches for directing fluid to specific segments within the pump.

21 Claims, 3 Drawing Sheets

LIQUID RING VACUUM PUMP-COMPRESSOR WITH ROTOR CONE CLEARANCE CONCENTRATED IN THE SEAL SEGMENT

CROSS REFERENCE TO RELATED APPLICATION

This application is a continuation-in-part of our copending U.S. patent application Ser. No. 07/882,820, filed May 14, 1992.

FIELD OF THE INVENTION

The present invention relates to liquid ring vacuum pumps or compressors, and more particularly to a method and a structure for extending the operating life of the pump while retaining the efficiency of pump operation throughout its operating life, and for simplifying clearances adjustments between critical parts and changing bearings. The invention is a liquid ring vacuum pump having critical operating clearances concentrated in the seal land area of the pump.

BACKGROUND OF THE INVENTION

A liquid ring vacuum pump or compressor apparatus includes a rotor mounted for rotation within a pump housing, with vanes extending generally radially forming a plurality of working chambers. A port-containing cone member has a large base end and an opposite small end, the cone member having sequentially an inlet segment, a compression segment, a discharge segment, and a seal segment. A pumped gaseous medium is admitted to and discharged from the working chambers through the ports in the cone. Two such cones are preferably mounted small end to small end within the housing to form a double-cone pump. Liquid ring vacuum pumps, as exemplified by Roe et al U.S. Reissue Pat. No. 29,747, which is incorporated herein by reference, use "seal water" to form a liquid ring of pumping chambers that compress the gas and push it out of the pump, and to form a seal between high pressure gas being discharged and low pressure gas entering the pump. This seal is formed in the angular land area segment of the 360 degree cycle, where the liquid ring pistons contact the cone surface. As used herein, the land, land area, land segment, or seal segment of the cone shall mean the portion of the cone which is in closest communication with the working water pistons. The efficiency of the pump depends on the seal created by both the radial clearance of the metal surfaces of the rotor vanes and cone surface and the liquid pistons contacting the cone land area.

Metal parts of a liquid ring pump, particularly the rotor vane inner tapered surfaces and the land area of the cone, have a critical radial clearance in manufacture to achieve maximum efficiency in operation. In the past, this critical clearance has been the same in all four segments of the cone surface.

The sealing liquid in the pump is required in the land area segment of the cone between the rotor blades and the land area surface to prevent the high pressure discharge gas from bypassing the gas outlet and recirculating to the inlet segment of the pump, thereby avoiding reducing the volume of gas displacement and the efficiency of the pump. Sealing water is not needed between the rotor blades and cone surface in the other three segments of the cone, namely; inlet, compression, and discharge, except at the smaller diameter of the cone. In these three segments, working pistons are needed to allow gas to fill between the rotor blades, to compress and discharge the gas through and out of the pump. Seal water is needed at the small diameter of the cone in all four segments of the cone.

In prior art designs, the cone surfaces have required careful machining in order that all surfaces meet a stringent straightness requirement. The same careful machining has also been required in the repair of a cone during the rebuilding of a pump.

DESCRIPTION OF THE PRIOR ART

Applicants are aware of the following U.S. Patents concerning liquid ring pumps:

| U.S. Pat. No. | Inventor | Title |
|---|---|---|
| 3,209,987 | Jennings | LIQUID RING PUMP |
| 3,743,443 | Jennings | VACUUM PUMP |
| Re. 29,747 | Roe et al. | LIQUID RING PUMP LOBE PURGE |
| 4,747,752 | Somarakis | SEALING AND DYNAMIC OPERATION OF A LIQUID RING PUMP |

SUMMARY OF THE INVENTION

The invention provides a cone with close radial clearance to the rotor blades primarily in the land area and the small diameter end of the cone. A non-working (excess) clearance is provided in the other three segments of the cone, namely; inlet, compression, and discharge segments. This allows control of the cone to rotor clearance to be made over the land area of the cone where this radial clearance is needed to keep the high pressure discharge gas from recirculating past the land area into the inlet segment.

OBJECTS OF THE INVENTION

The principal object of the present invention is to provide a means for prolonging the useful life of critical metal surfaces of rotor vanes.

It is also an object of the invention to provide means for limiting damage to the adjacent metal surfaces of the cone and the rotor in the land area from friction or from scoring by particulates contained in the water within the pump.

Another object of the invention is to provide a liquid ring pump which will require reduced machining time of the tapered cone surface by reducing and limiting the overall area that requires precision machining to the land area segment.

Another object of the invention is to reduce the area that will require resurfacing and machining to repair a worn cone to just the land area segment.

Another object of the invention is to provide an improved means to minimize the total flow of sealing liquid to a cone port vacuum pump.

A further object of this invention is to provide apparatus for efficiently directing sealing liquid around the cone surface.

Another object of the invention is to prevent sealing liquid from passing over the discharge opening of the cone, and being immediately discharged and wasted without performing a function of either compression or sealing.

BRIEF DESCRIPTION OF THE DRAWINGS

The foregoing and other objects will become more readily apparent by referring to the following detailed description and the appended drawings in which.

DETAILED DESCRIPTION

Figure 1:
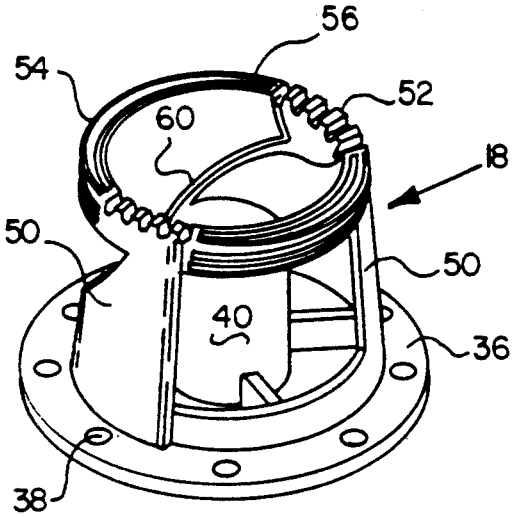
FIG. 1 is a schematic cross-section of a liquid ring pump in accordance with the invention.
Figure 2:
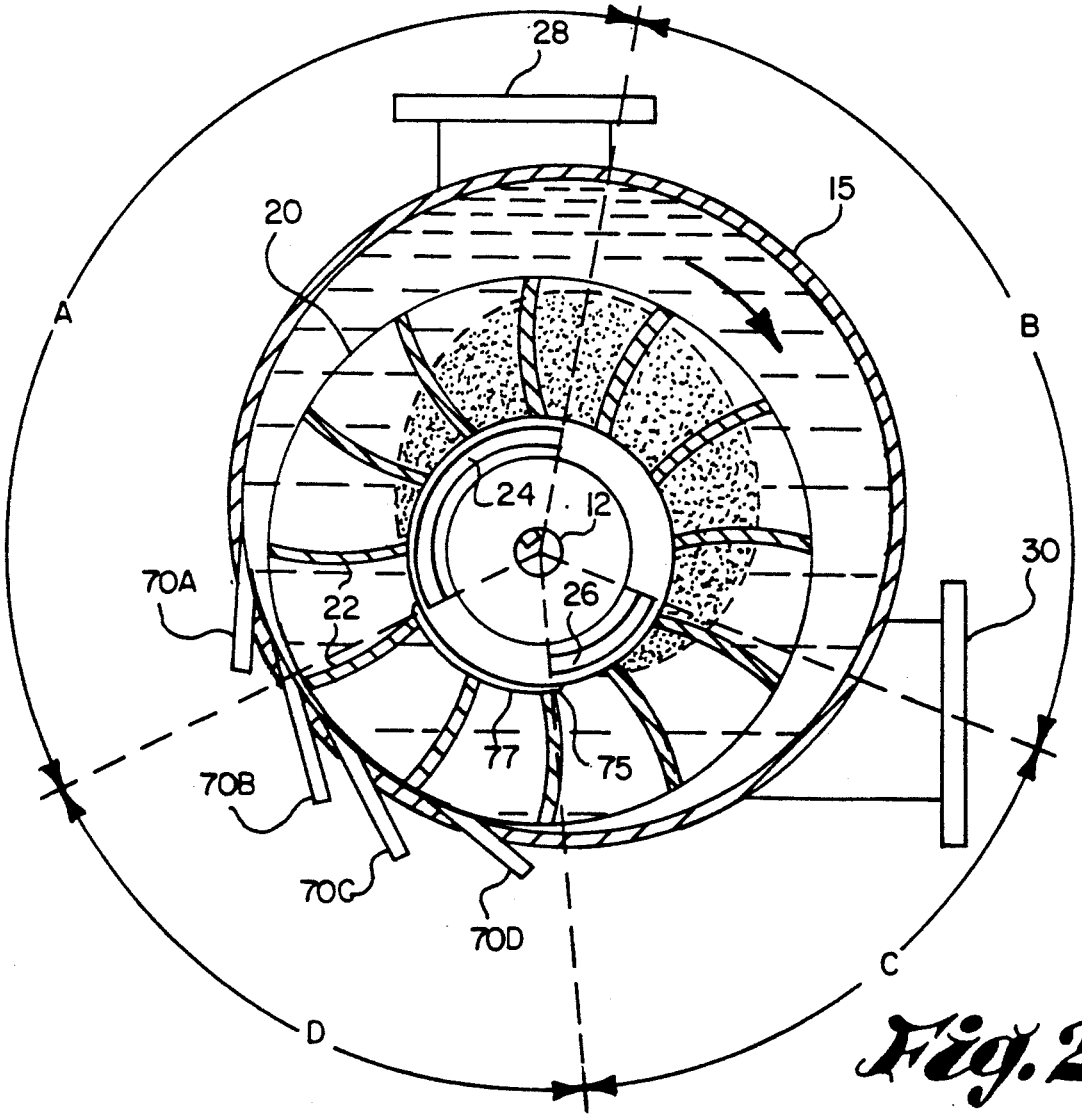
FIG. 2 is an isometric view of a cone showing the raised close clearance surface of the land area or seal segment and the lower more open clearance over the other three segments of the cone.
Figure 3:
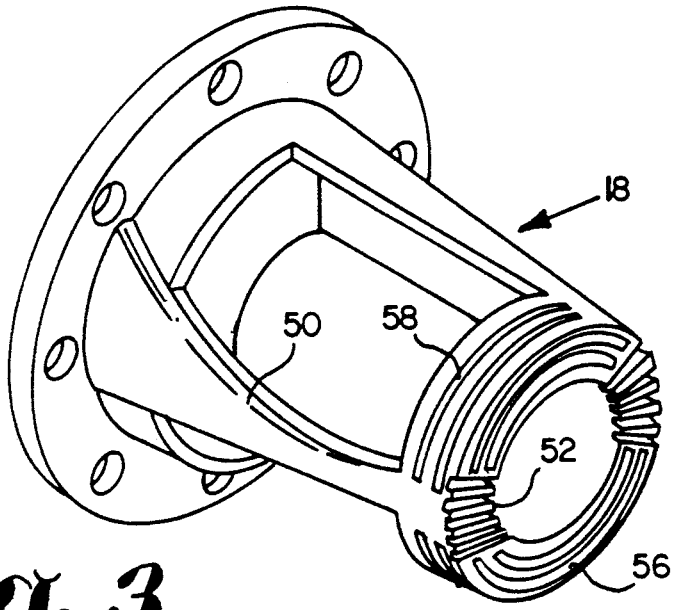
FIG. 3 is an isometric view of an alternative embodiment of the cone of FIG. 2.
Figure 4:
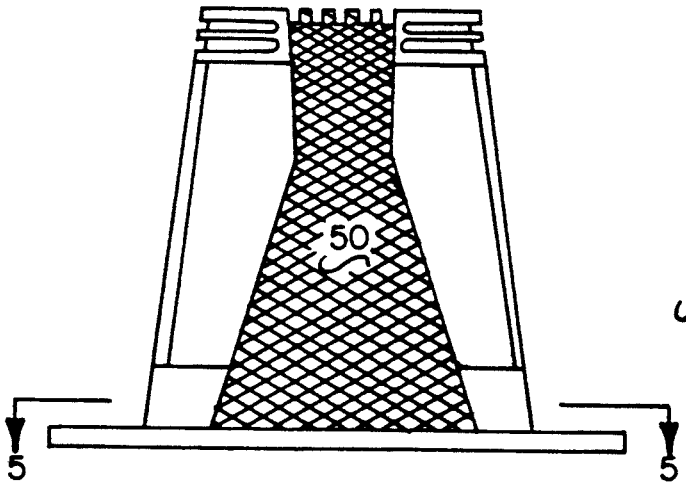
FIG. 4 is an exaggerated front view of the cone showing the land area which has a close clearance with respect to the rotor vanes.

Liquid ring pump operation takes place about four specific angular segments of the cone, as depicted in FIG. 1, which segments are: the gas inlet or intake segment A, the gas compression segment B, the compressed gas discharge segment C, and the liquid seal segment D, the last of which occurs at the land area.

Referring now to the drawings, a cone 18 for a liquid ring pump is fixed within pump housing 15, with the axis of the cone coextensive with the axis of shaft 12, the shaft passing through the cone. A rotor 20, having integral vanes or blades 22 mounted thereon, is fixed to the shaft, and rotates with the shaft relative but off-centered to the pump housing. Further, the shaft rotates within the cone while the rotor rotates about the cone. A gas inlet port 24 and gas outlet port 26 are provided on opposite sides of the cone, as shown. Gas inlet 24 communicates with housing gas inlet passageway 28, while gas outlet 26 communicates with housing gas outlet passageway 30.

Between the end of the gas outlet port 26 and the beginning of the gas inlet port 24 is the area 50 of the cone known as the "land" or seal segment. It is important to provide a seal in the land area 50 between the two gas ports 26 and 24 to prevent the passage of gas through or over this seal segment. This is accomplished by passing fresh clean water through and over the cone to provide a layer of clean water 77 between the two metal surfaces of the cone and the rotor effecting a liquid seal between the inlet and outlet ports of the cone. It is also important to prevent damage to the adjacent metal surfaces of the cone and the rotor in the land area from friction or from scoring by particulates contained in the water within the pump by maintaining this liquid seal.

Figure 5:
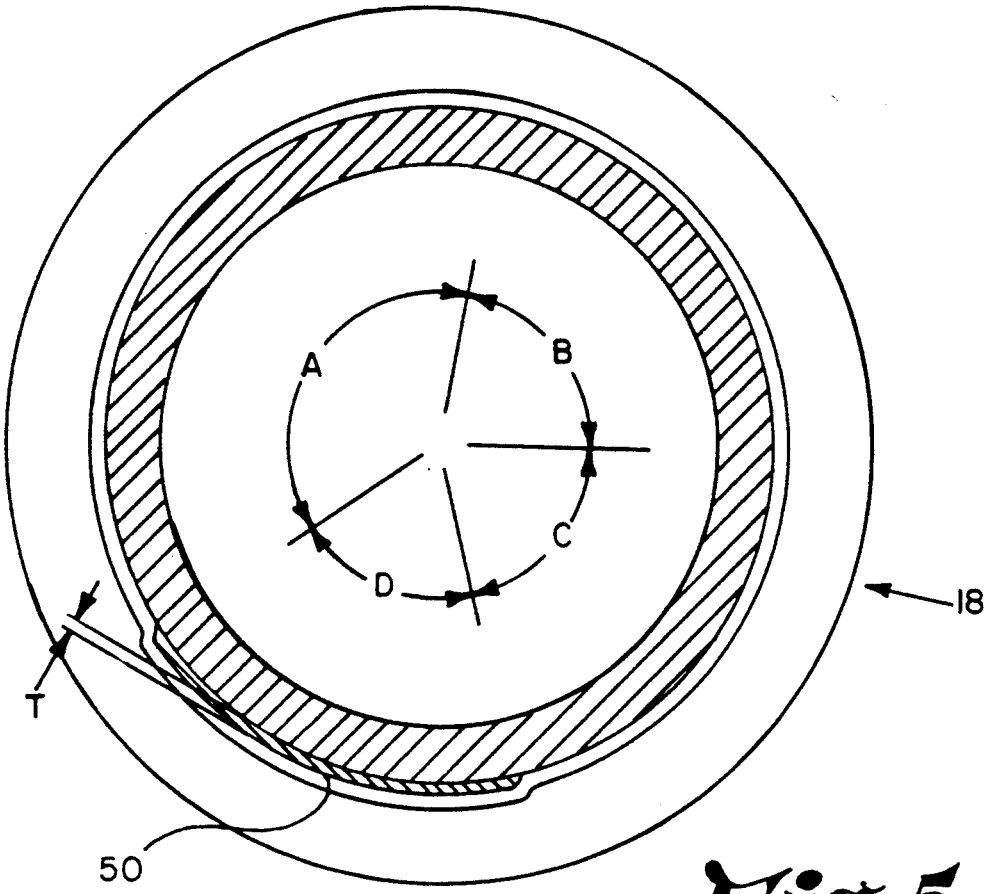
FIG. 5 is a cross-section of the cone of the invention taken along line 5—5 of FIG. 4.

In the present invention, the seal segment of the cone is thicker by a thickness T (see FIG. 5) than the other three segments. The thickness T can vary from 0.050 to 0.125 inches, but preferably is about 0.080 inches. The additional thickness T of metal can be provided on the seal segment during the casting of the cone. This segment then is the only one which requires machining, the other segments may remain a rough casting, or be subject to only light machining. Alternatively, the additional thickness T can be provided by a coating of metal, either the same material as the cone or a different material. This coating can be a hardened metal or a corrosion or erosion resistant material, such as stainless steel, wrought iron. The thickness T of metal can be flame applied ceramic or ceramic metal. It can be pickled or annealed. The thickness T of metal can be affixed to the surface of the cone by flame spray, metal spray, or in certain instances a preformed attachment can be plug welded or spot welded into place, or fixed onto the cone by any other desired means.

The rotor vanes come into close but not actual contact (i.e., close clearance) with the cone surface only in the area of seal segment 50 where this close clearance performs the function of a seal, thus preventing high pressure gas from passing over the seal segment or land area into the inlet segment of the cone. The increase in radial clearance of the vanes over the remaining three segments of the cone reduces the exposure of the rotor vanes to close clearances which often result in actual contact with attendant wear, with a resultant opening of the land segment clearance and causing a loss of efficiency of the pump.

When centering the rotor of a double cone pump, the rotor is adjusted axially along the shaft until it jams on one cone, then the rotor is adjusted in the other direction until it jams on the second cone, then is centered between these two limits. The present invention avoids the adjustment error created by encountering a high spot on some segment other than the land segment which results in a inefficient seal in the land area, because there is no way to determine which portion or segment of the cone had the high spot. In addition, only the seal segment needs to be machined, since it is the only segment that is subject to wear.

The cone 18 is provided with a series of radial notches 52 at the small end 54 or tip thereof. There are generally from one to about eight of such notches, which are closely spaced and located adjacent either the land or compression segments, but preferably both. The notches can have any desired cross-section, including triangular, rectangular, trapezoidal, round, or oval. Advantageously, the cone 18 is also provided with one or more annular labyrinth grooves 56 in the flat area, or face, of the cone end 54 between the areas of the notches 52, as shown. Either alternatively or in addition to grooves 56, one or more annular labyrinth grooves 58 may be provided on the side of the cone near the end 54 in the intake and discharge areas. A spiral groove or closed conduit 60 may be provided in the interior portion 40 of the cone, connecting a fresh water inlet with the radial notches 52. The annular and spiral grooves and/or conduit likewise can have any desired cross-section. The set of grooves and notches are generally machined into the cone, but may be formed in casting.

The radial notches or grooves 52 in the land segment or land and compression segments D and B of the cone 18 direct the flow of sealing water toward the land segment or land and compression segments of the cone, and secondly, the circular labyrinth grooves 56 and 58 reduce the water flow velocity and thereby restrict the flow of the liquid from entering the inlet and discharge segments A and C of the cone. These structural features concentrate the flow of seal water to the location where it is most needed, and restrict the flow of water over the segments through which gas flows in a radial direction between the cone and the surface of the working piston of liquid.

ALTERNATIVE EMBODIMENTS

Figure 6:
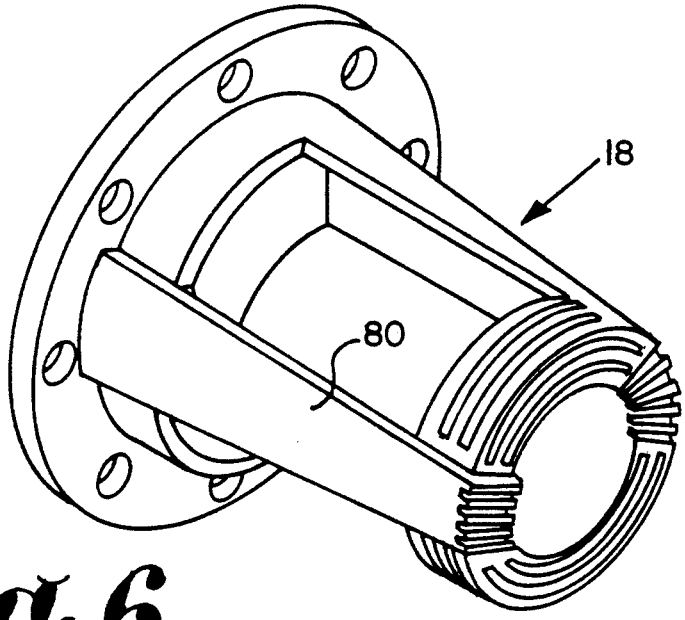
FIG. 6 is an isometric view of another alternative embodiment of a cone, having a replaceable wear plate.

Alternatively, the land segment 50 of the cone which is subject to wear by the close radial clearance to the rotor blades, can be a replaceable wear plate 80 of hard material (see FIG. 6). The purpose of this segment being removable is to replace the surface as a spare part, rather than replace the entire cone 18, which dimensionally and structurally meets the specifications for operation.

The present invention is equally applicable to a single cone pump and a double-cone pump.

SUMMARY OF THE ACHIEVEMENT OF THE OBJECTS OF THE INVENTION

From the foregoing, it is readily apparent that we have invented an improved apparatus for prolonging the useful life of critical metal surfaces of rotor vanes, as well as a liquid ring pump which will require reduced machining time of the tapered cone surface by reducing and limiting the overall area that requires precision machining to the land area segment.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. In a liquid ring vacuum pump or compressor apparatus including a port-containing cone member having a large base end and an opposite small end with an end face thereon, said cone member having sequentially an inlet segment, a compression segment, a discharge segment, and a seal segment;

the improvement comprising the exterior surface of the seal segment having a greater radius and the seal segment being of greater thickness than the other segments.

2. Apparatus according to claim wherein said cone is a ferrous metal casting.

3. Apparatus according to claim 1, wherein the face of said seal segment of said cone has a metal coating thereon.

4. Apparatus according to claim 1, wherein the exterior surface of the seal segment has a radius from 0.050 to 0.125 inches greater than the thickness of the other segments.

5. Apparatus according to claim 4, wherein the exterior surface of the seal segment has a radius about 0.080 inches greater than the thickness of the other segments.

6. Apparatus according to claim 1, wherein said cone member is stainless steel.

7. Apparatus according to claim 1, wherein said cone member is wrought iron.

8. Apparatus according to claim 3, wherein said coating is a ceramic material.

9. Apparatus according to claim 1, wherein said seal segment includes a preformed segment cover affixed to the surface of the cone.

10. Apparatus according to claim 1, wherein the seal segment and the small end of said cone are machine finished, and the remaining segments are rough cast.

11. Apparatus according to claim 1, wherein said cone is provided with at least one radial notch at the small end of the cone for directing water from the interior of the cone over the small end of the cone to the seal segment of the cone.

12. Apparatus according to claim 1, wherein said cone is provided with at least one radial notch at the small end of the cone for directing water from the interior of the cone over the end of the cone to the compression segment.

13. Apparatus according to claim 1, wherein said cone is provided with a plurality of closely spaced notches at the small end of the cone for directing water from the interior of the cone over the seal segment of the cone.

14. Apparatus according to claim 1, wherein the cone is also provided with at least one annular labyrinth groove in the end face of the cone for restricting water flow around the cone and from entering the inlet and discharge segments.

15. Apparatus according to claim 1, wherein the cone is also provided with at least one annular labyrinth groove in the side of the cone adjacent the cone end for restricting water flow around the cone and from entering the inlet and discharge segments.

16. A method for increasing the wear life of a cone member of a liquid ring vacuum pump or compressor apparatus having sequentially an inlet segment, a compression segment, a discharge segment, and a seal segment, the method comprising:

providing a seal segment of greater radius and thickness than the other segments.

17. A method according to claim 16, wherein a metal coating is applied to said seal segment by flame spraying.

18. A method according to claim 16, further comprising annealing said cone member.

19. A method according to claim 16, further comprising pickling said cone member.

20. A method according to claim 16, further comprising forming a metal cover substantially congruent with said seal segment and having a thickness of from about 0.050 to 0.125 inches, and attaching said metal cover to said seal segment.

21. A method according to claim 16, wherein a ceramic or ceramic metal coating is applied to the surface of said seal segment.

* * * * *

UNITED STATES PATENT AND TRADEMARK OFFICE

CERTIFICATE OF CORRECTION

PATENT NO. : 5,222,869

DATED : June 29, 1993

INVENTOR(S) : Charles H. Wunner and T. Michael Wallace

It is certified that error appears in the above-indentified patent and that said Letters Patent is hereby corrected as shown below:

Column 5, line 44, in claim 2, after "claim", insert -- 1 --

Signed and Sealed this

Twentieth Day of June, 1995

*Attest:*

*Attesting Officer*

Bruce Lehman

BRUCE LEHMAN

*Commissioner of Patents and Trademarks*